US009000947B1

(12) United States Patent
Frank

(10) Patent No.: US 9,000,947 B1
(45) Date of Patent: Apr. 7, 2015

(54) SYSTEM AND METHOD FOR CONTROLLING A HOT PURSUIT SITUATION

(71) Applicant: D. Lane Frank, Lukeville, AZ (US)

(72) Inventor: D. Lane Frank, Lukeville, AZ (US)

( * ) Notice: Subject to any disclaimer, the term of this patent is extended or adjusted under 35 U.S.C. 154(b) by 0 days.

(21) Appl. No.: 13/987,468

(22) Filed: Jul. 29, 2013

(51) Int. Cl.

| | |
|---|---|
| ***G08G 1/07*** | (2006.01) |
| ***G08G 1/123*** | (2006.01) |
| ***F42B 7/04*** | (2006.01) |
| ***F42B 12/36*** | (2006.01) |
| ***G08G 1/087*** | (2006.01) |

(52) U.S. Cl.
CPC ..... *G08G 1/123* (2013.01); *F42B 7/046* (2013.01); *F42B 12/365* (2013.01); *G08G 1/087* (2013.01)

(58) Field of Classification Search
USPC ..... 340/906, 539.13
See application file for complete search history.

(56) References Cited

U.S. PATENT DOCUMENTS

| | | | | |
|---|---|---|---|---|
| 6,246,323 | B1 * | 6/2001 | Fischbach | 340/539.13 |
| 6,650,283 | B2 | 11/2003 | Brydges et al. | |
| 7,453,356 | B2 | 11/2008 | Bedenko | |
| 7,990,265 | B2 | 8/2011 | Fischbach et al. | |

* cited by examiner

*Primary Examiner* — Shirley Lu
(74) *Attorney, Agent, or Firm* — Paul R. Martin

(57) ABSTRACT

A system and method for controlling a hot pursuit situation in which an electronic device is attached to a fleeing vehicle to be tracked by projecting it, as by shooting it from a firearm, against the fleeing vehicle. The device is contained in a frangible pellet, having an outer casing containing a sticky substance coating the electronic device contained within that will be attached to the fleeing vehicle upon impact. In addition to containing circuitry for tracking the vehicle, the circuitry of the pellets contain circuitry to change traffic lights in the vicinity of the vehicle to green for the fleeing vehicle so crossing traffic is prevented from moving in front of the fleeing vehicle at an intersection through which the fleeing vehicle is passing.

4 Claims, 4 Drawing Sheets

SYSTEM AND METHOD FOR CONTROLLING A HOT PURSUIT SITUATION

TECHNICAL FIELD OF THE INVENTION

The present invention relates to the general art of motor vehicles, and to the particular field of controlling a hot pursuit situation. It is also useful in other situations where it is desirable to be able to track any fleeing or moving object, whether an automobile, motorcycle, truck or other vehicle, and even human beings who may be fleeing on foot.

BACKGROUND OF THE INVENTION

Various law enforcement agencies engage in the pursuit of vehicles. Although the majority of drivers cooperate with law enforcement, on many occasions the drivers refuse to do so, and attempt to escape from authorities. These drivers are often chased by authorities attempting to subdue them at high speeds ("hot pursuit"). Although the reasons for fleeing may vary, most often these hot pursuits involve tracking of vehicles which may have been, for example, used in the commission of a crime, may have been stolen, whose occupants may have been engaged in criminal activity and are fleeing a crime scene, etc. A major problem associated with law enforcement's hot pursuit of fleeing vehicles is the risk of injury to police personnel involved in the chase, risk to the occupants of the fleeing vehicle, and more importantly, the risk of injury to the public because these hot pursuits are occurring on public streets and highways. The news media frequently report about individuals who have been killed or injured when they or a vehicle they were in was struck by either a fleeing vehicle, or by the pursuing law enforcement vehicle. So, there is a need to be able to track fleeing vehicles, or individuals in a safer manner than has previously been the case.

Numerous law enforcement vehicles may simultaneously be pursuing the same vehicle, and they are informed by radio or similar means of communication of the fleeing vehicle's position by the observations of personnel in a pursuing vehicle. A helicopter or other aircraft may monitor the fleeing vehicle's location in some instances and report the location to pursuit vehicles on the ground. A limitation of visual observation, however, is that the fleeing vehicle may be lost if it gets out of sight of the tracking vehicle, the weather is bad and there is poor visibility, or at night.

Several solutions have been proposed in response to the dangers of high speed chases. A system commonly known as "stop sticks" is used by law enforcement personnel to disable a fleeing vehicle. The stop sticks are very dangerous. A "stop stick" is a long stick that has a series of spikes along its outer surface. Stop sticks are placed on the road in the path of a fleeing vehicle in order to puncture the vehicle's tires as it rolls over the stop sticks. The launching mechanism of these systems employs an explosive charge or a spring mechanism to launch the spiked projectile in front of the rear tires of the fleeing vehicle, thereby puncturing the tires as the vehicle rolls over the spiked projectile. However, stop sticks has several drawbacks. First, placing the spiked object in front of a high speed vehicle can be dangerous and haphazard. Second, the driver of the vehicle may lose control after its tires are punctured and may strike nearby pedestrians or police officers. Additionally, new tire designs are being introduced that are resistant to punctures and can function without air in them, negating the effectiveness of these devices.

Other systems are available which disable a vehicle in a controlled manner. Such systems often employ a remote vehicle disabling system comprising a receiver in a vehicle which cuts off the vehicle's fuel supply after receiving a signal from a transmitter. The fuel is cut off in stages so that the driver can bring the vehicle to a stop in a controller manner.

In lieu of disabling a vehicle, systems are available that track the location of a vehicle so that police may apprehend the driver at a later time. These systems track stolen or lost vehicles using hidden radio transponders in the vehicle, which upon receiving an activation signal transmits a return signal that enables the vehicle's location to be determined. These remote systems are generally designed to protect against the unauthorized use of an owner's vehicle, and require the installation of a receiver, GPS or otherwise, in the vehicle. Without the installation of a receiver, the police cannot track the vehicle's location.

Although high speed pursuits are often necessary to apprehend dangerous criminals, they often result in high speed collisions that cause serious or fatal injuries to the police, innocent motorists or pedestrians, and even the criminals being chased. Ironically, it is both the pursuit by the police and the criminal's desire not to be caught that fuel the high speed chase. Consequently, if there is no pursuit by the police, a high speed chase would not occur. However, if a law enforcement agency has a "no chase" policy, then the crime rate in that jurisdiction is likely to increase as a result. Therefore, a need exists for a system that law enforcement personnel can use to track the movement of a suspect motor vehicle, or an individual without encouraging a high speed chase. As described in detail below, the present invention provides such a system, which resolves the existing safety problems associated with high speed pursuits, and other similar problems.

In addition to the just-discussed problems associated with a high-speed police chase, there is yet another problem. In a high-speed chase situation, since the fleeing vehicle is not likely to stop for a red traffic light, it has the need to cross or pass all intersections it encounter, even if an intersection is controlled by a traffic signal. This must be accomplished in the least amount of time possible so that the fleeing vehicle can clear the intersection as quickly as possible.

In the case of a high-speed chase, the pursuing vehicles generally have their sirens on to warn drivers of the situation. In the case of a street intersection these sirens, horns, bells or other types of audible and/or visible warning devices alert other people in the intersection. This has not always proven to be a successful technique, even though it is still the standard mode of operation today. Unfortunately, accidents involving such fleeing vehicles, and even the pursuing vehicle, often occur at intersections due to confusion, impaired hearing, inattention, noise conditions or overly-aggressive drivers seeking to clear the intersection before the arrival of the situation. Other factors are the speed of the high-speed chase and the resulting inability of others to react to it, distractions affecting the driver of the fleeing vehicle, and the like. Further problems are caused when multiple vehicles are approaching the same intersection. This situation is further complicated when the sirens and other signals from multiple vehicles can be heard within the same area. This combination can be confusing to both pedestrians and other motorists. In many cases, due to siren noise and the intensity of focused driving at high speeds through congested areas, the drivers of the vehicles involved in the chase are often not aware of other vehicles in the same area.

Therefore, there is a need to control traffic in all directions along a route being taken during a high-speed chase.

SUMMARY OF THE INVENTION

These, and other, objects are achieved by a system and method for controlling a hot pursuit situation in which a device is attached to a fleeing vehicle to be tracked by projecting it, as by shooting it from a firearm, against the fleeing vehicle. The same system can also be used to track fleeing individuals down alleys and other places where vehicles are not normally found. The device comprises a frangible pellet comprising a frangible outer casing which contains a sticky substance in the interior thereof that will remain intact when the pellet is propelled from a chase vehicle and will attach to the fleeing vehicle upon impact. The sticky substance contains circuitry for tracking the vehicle, or or other object to which it is attached. The pellet may also contain circuitry to change traffic lights in the vicinity of the vehicle to green for the fleeing vehicle so crossing traffic is prevented from moving in front of the fleeing vehicle at an intersection through which the fleeing vehicle is passing. This feature is intended to prevent dangerous street intersection crashes between the fleeing vehicle and a vehicle entering an intersection with a green light as the fleeing car is not likely to stop for a red light. The traffic signal control circuitry can also contain circuitry which causes the traffic lights to flash or operate in a non-normal manner to attract motorist's attention to the traffic signal so they will not proceed through an intersection in a normal manner but will stop, even if they are expecting a green light.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
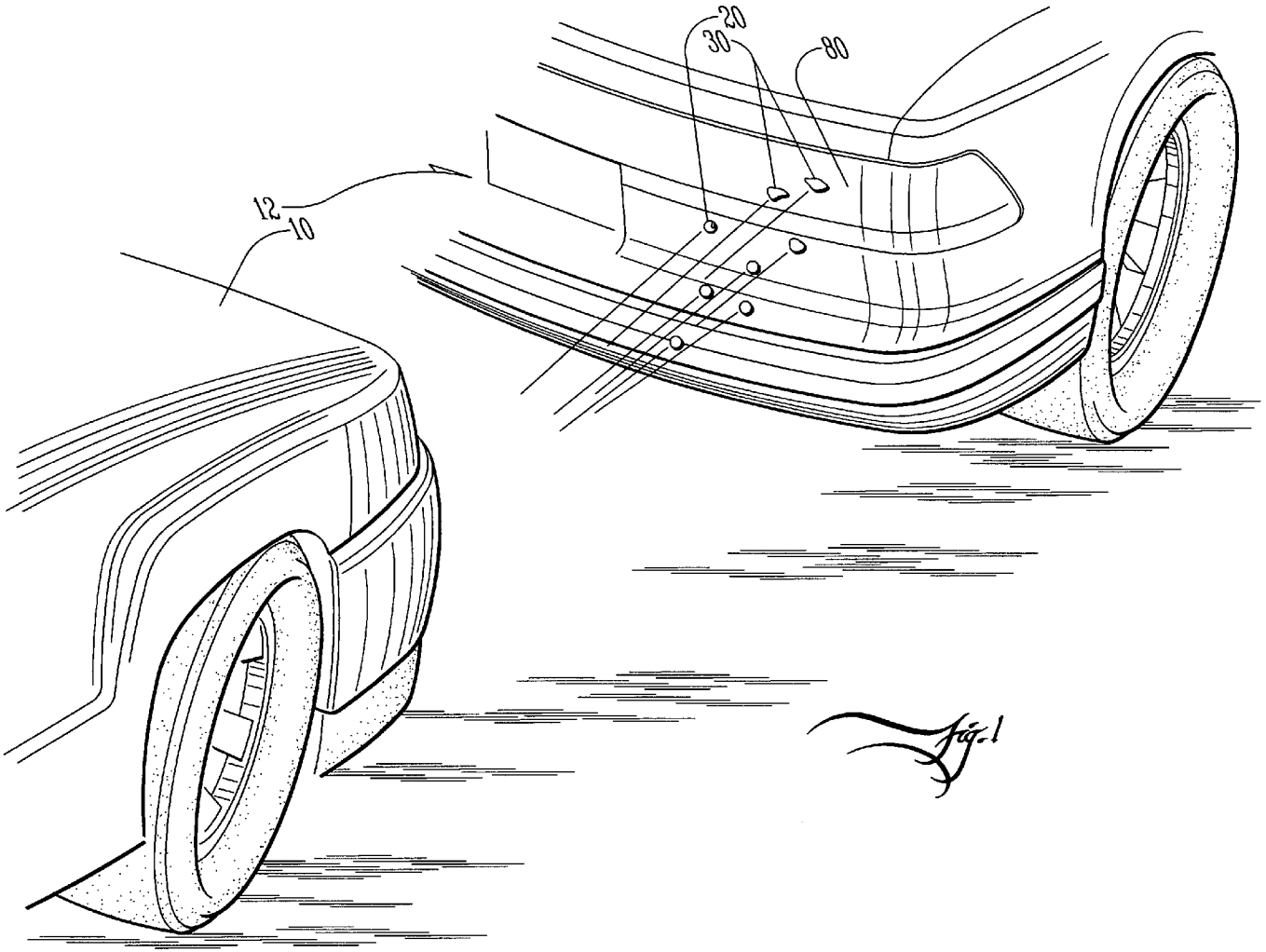
FIG. 1 illustrates a fleeing vehicle which has been impacted with pellets containing tracking and traffic signal control circuitry in accordance with the teaching of the present disclosure.
Figure 2:
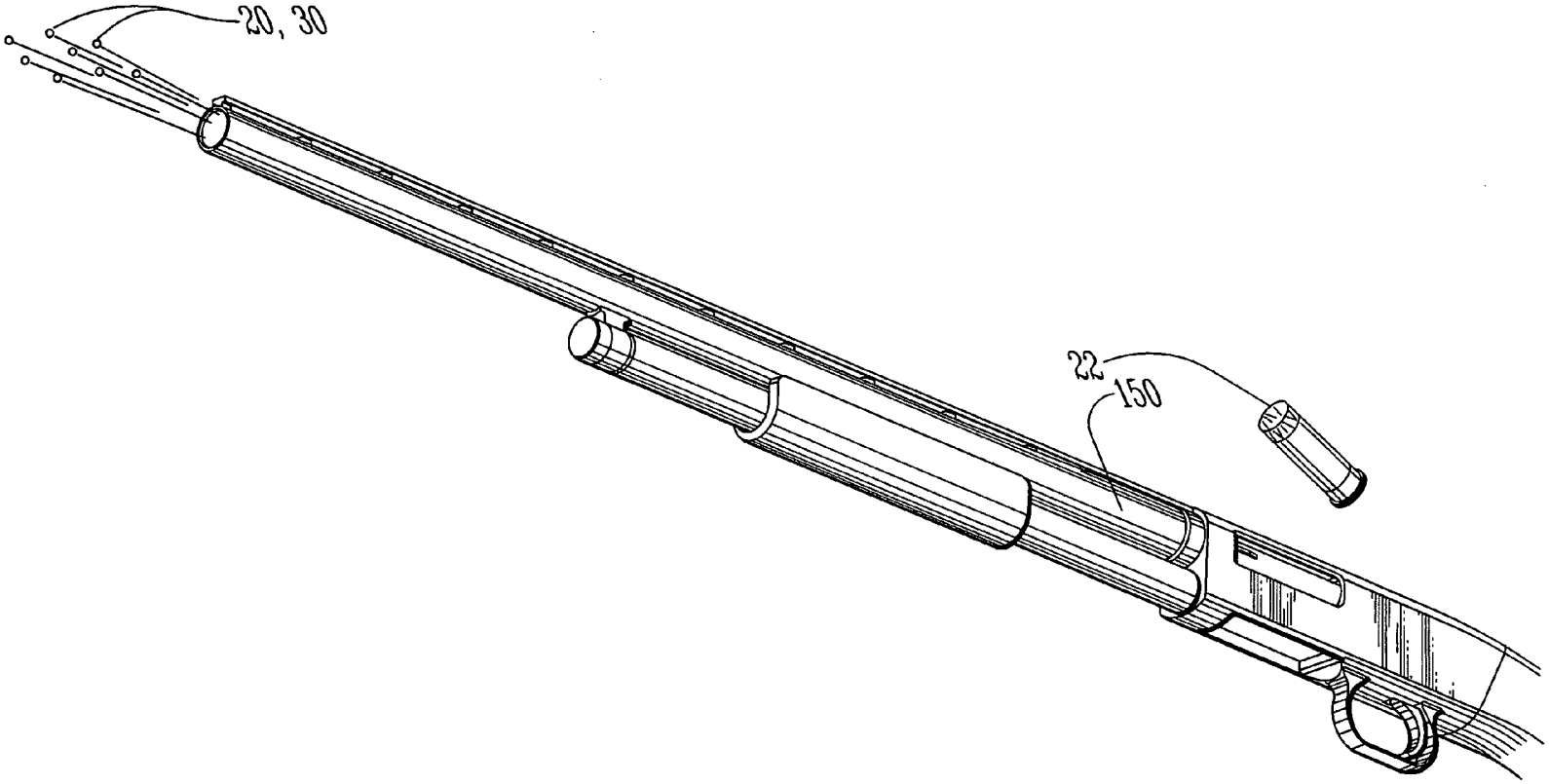
FIG. 2 illustrates one form of means for projecting the pellets at a fleeing vehicle.
Figure 3:
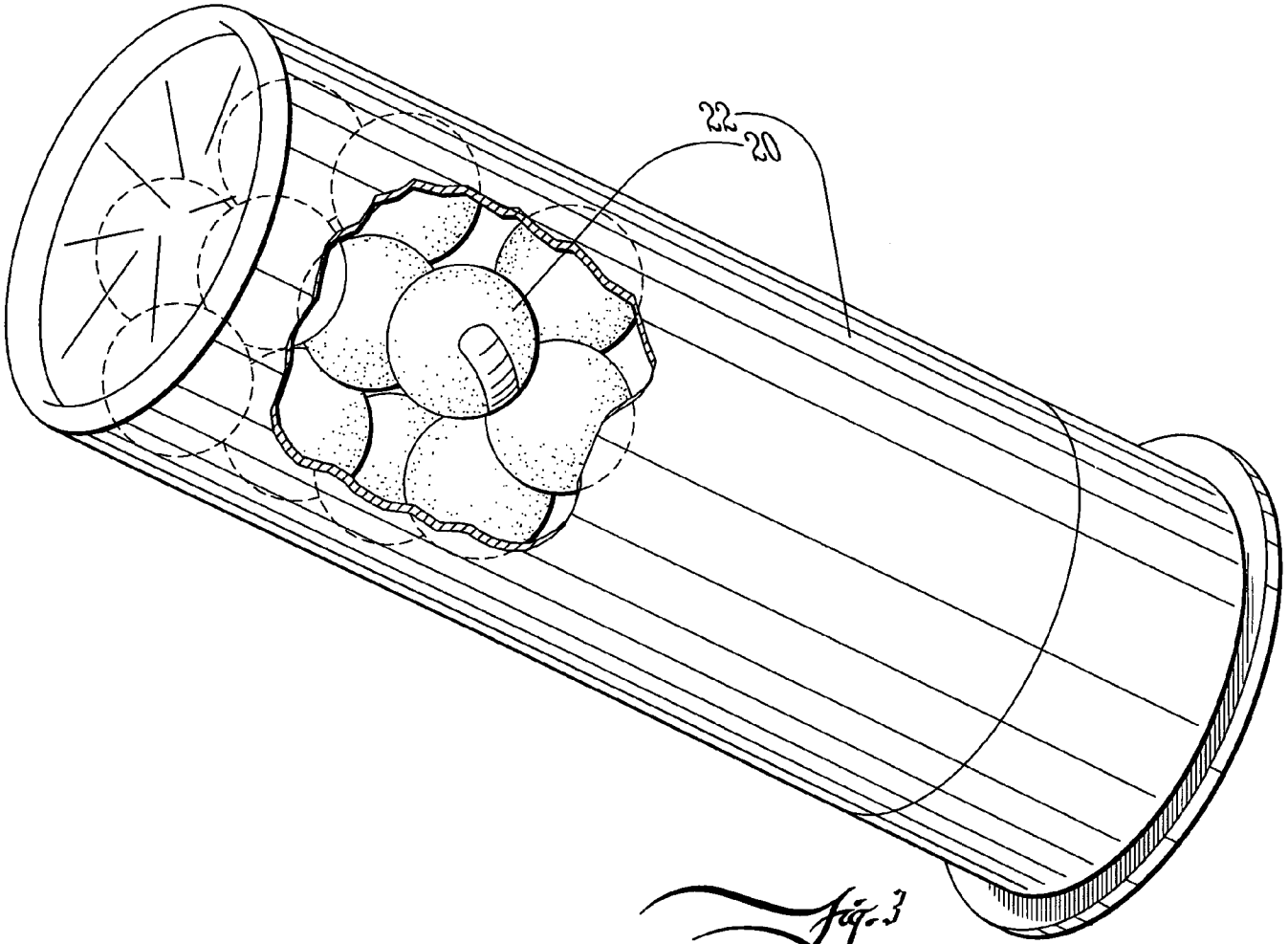
FIG. 3 shows a casing containing a multiplicity of pellets and which is used in the projecting means to project those pellets at a fleeing vehicle.
Figures 4, 5:
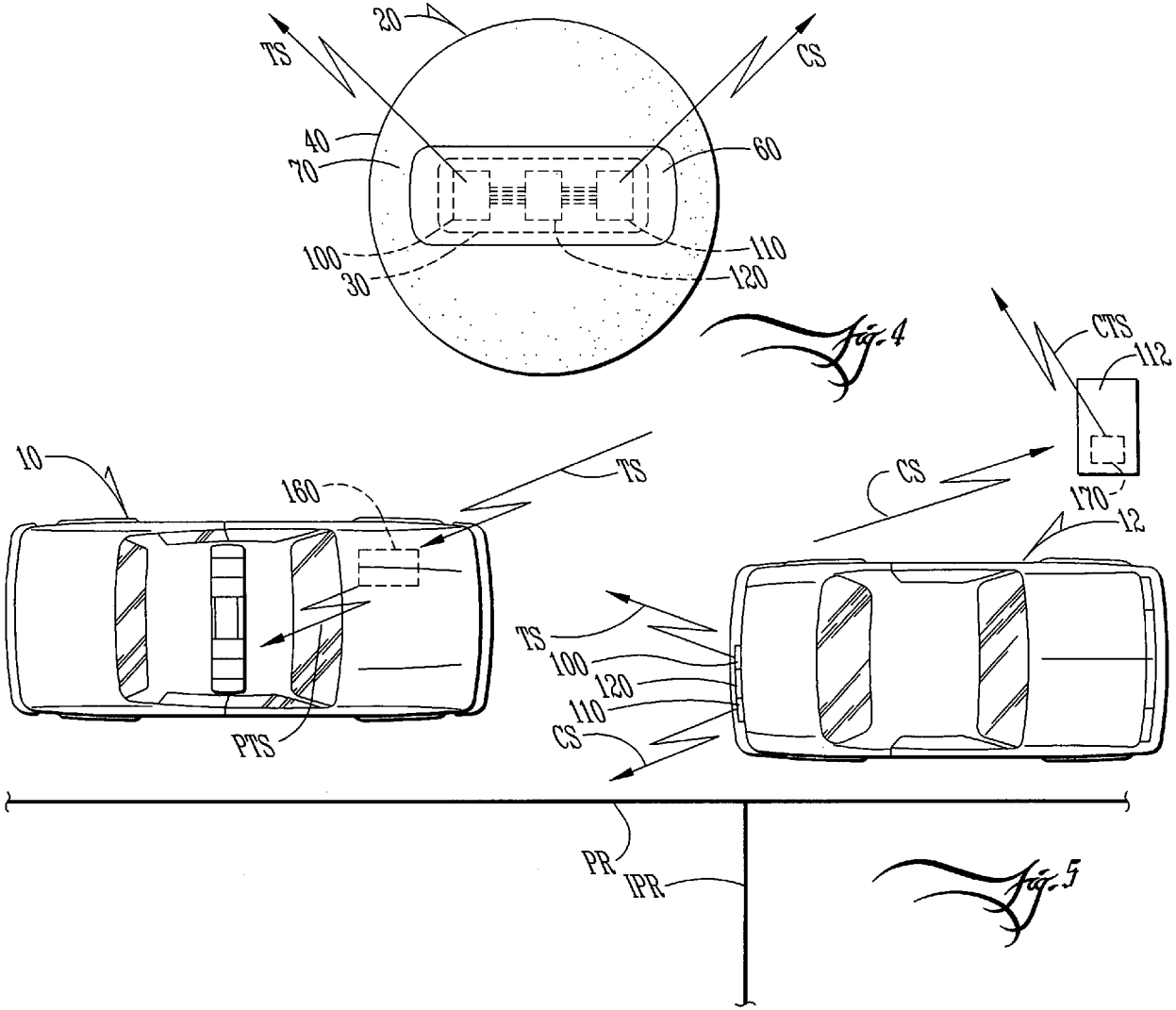
FIG. 4 shows a pellet used in the system and method embodying the teaching of the present disclosure.
FIG. 5 is a schematic illustrating the system and method embodied in the teaching of the present disclosure.

Referring to the figures, it can be understood that the present invention is embodied in a system and method for controlling a pursuit by a pursuing vehicle 10 of fleeing vehicle 12 during a hot pursuit situation. The system comprises a multiplicity of projectile pellets, such as pellet 20 contained in a shell 22 such as a shotgun shell and which is fired in the manner of a shotgun. Each projectile pellet 20 has a frangible outer casing 40, preferably plastic. Contained within the outer casing 40 is an adhesive substance 70. Each pellet further comprises circuitry 50 contained within an outer casing 30 which is encapusulated by the adhesive substance 70. Circuitry 50 in each pellet includes an outer surface 60 covered with the adhesive 70 which adheres to a surface 80 of fleeing vehicle 10 upon contact therewith.

Circuitry 50 includes first circuitry 100 which generates a tracking signal TS upon activation, second circuitry 110 which generates a traffic signal control signal CS upon activation to control operation of roadway intersection traffic signals 112, and third circuitry 120 which activates the first circuitry and the second circuitry upon impact with a fleeing vehicle. It is noted that those skilled in the art will understand how to make and use circuitry 100 and 110 based on the teaching of this disclosure and the teaching of disclosures such as U.S. Pat. Nos. 4,573,049, 5,014,052 and 5,443,783, the disclosures of which are incorporated herein by reference. The exact details of the circuitry of this system and method are not being claimed and, as such, will not be disclosed in detail.

The system further includes a projecting means 150, such as a firearm, for projecting the multiplicity of pellets at fleeing vehicle 12, or other objects. The projecting means can be located inside a pursuing vehicle or fired from adjacent to the roadway. The system further includes in-vehicle receiver circuitry 160 located in pursuing vehicle 10. Circuitry 160 is adapted to receive signals TS generated by the first circuitry when the first circuitry is activated upon impact with the fleeing vehicle and to generate tracking signals PTS in the pursuing vehicle for occupants in the pursuing vehicle to use in tracking the fleeing vehicle. The system further comprises traffic-light receiver circuitry 170 located in roadway intersection traffic lights 112 which is adapted to receive signals CS from the second circuitry attached to a fleeing vehicle when the second circuitry is activated upon impact with the fleeing vehicle and generate traffic-light control signals CTS to turn an associated traffic light green for a roadway PR on which the fleeing vehicle is traveling and red for all traffic on roadways such as IPR intersecting the roadway on which the fleeing vehicle is traveling.

The method includes projecting the multiplicity of pellets at a fleeing vehicle; impacting the fleeing vehicle with pellets; fracturing the outer casing of pellets upon impacting the fleeing vehicle; adhering the circuitry of the pellets covered by the adhesive substance to the fleeing vehicle which has been impacted by the pellets; activating the first circuitry and generating tracking signals from the first circuitry of the pellets adhered to the fleeing vehicle; activating the second circuitry in the pellets adhered to the fleeing vehicle and generating traffic-light controlling signals from the fleeing vehicle; activating traffic-light receiver circuitry in all traffic lights located near the fleeing vehicle using the signals generated by the activated second circuitry in the fleeing vehicle and received by the traffic-light receiver circuitry; and activating the in-vehicle receiver circuitry in the pursuing vehicle to receive signals generated by the activated first circuitry in the pellets adhered to the fleeing vehicle and generating tracking signals in the pursuing vehicle.

As previously described, the system and method of the invention can also be used in connection with fleeing individuals wherein the pellets are shot from a shotgun or other projecting apparatus such as a pistol, and fracture on impact, thereby enabling the sticky substance containing the electronic circuitry to stick to the clothing of such individual, thereby enabling the individual to be tracked.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A method of controlling pursuit of a fleeing vehicle during a hot pursuit situation comprising:

(A) providing a multiplicity of projectile pellets, each projectile pellet having (1) a frangible outer casing, and (2) an adhesive substance contained within said outer casing, and (3) electronic circuitry contained within the outer casing, the circuitry including an outer surface covered with said adhesive substance which adheres to a surface of a fleeing vehicle upon contact therewith, the circuitry including (a) first circuitry which generates a tracking signal upon activation, (b) second circuitry which generates a traffic signal control signal upon activation, and (c) third circuitry which activates the first circuitry and the second circuitry upon impact with a fleeing vehicle;

(B) providing projecting means for projecting the multiplicity of pellets at a fleeing vehicle;

(C) providing in-vehicle receiver circuitry located in a pursuing vehicle which receives signals generated by the first circuitry when the first circuitry is activated upon impact with the fleeing vehicle and generate tracking signals in the pursuing vehicle;

(D) providing traffic-light receiver circuitry in roadway intersection traffic lights which receives signals from the second circuitry attached to a fleeing vehicle when the second circuitry is activated upon impact with the fleeing vehicle and generate traffic-light control signals to turn an associated traffic light green for a roadway on which the fleeing vehicle is traveling and red for all traffic on roadways intersecting the roadway on which the fleeing vehicle is traveling;

(E) projecting the multiplicity of pellets at a fleeing vehicle;

(F) impacting the fleeing vehicle with pellets;

(G) fracturing the outer casing of pellets impacting the fleeing vehicle;

(H) adhering the circuitry of the pellets to the fleeing vehicle which has been impacted by the pellets;

(I) activating the first circuitry and generating tracking signals from the first circuitry of the pellets adhered to the fleeing vehicle;

(J) activating the second circuitry in the pellets adhered to the fleeing vehicle and generating traffic-light controlling signals from the fleeing vehicle;

(K) activating traffic-light receiver circuitry in all traffic lights located near the fleeing vehicle using the signals generated by the activated second circuitry in the fleeing vehicle and received by the traffic-light receiver circuitry; and (L) activating the in-vehicle receiver circuitry in the pursuing vehicle to receive signals generated by the activated first circuitry in the pellets adhered to the fleeing vehicle and generating tracking signals in the pursuing vehicle.

2. A system for controlling pursuit of a fleeing vehicle during a hot pursuit situation comprising:

(A) a multiplicity of projectile pellets, each projectile pellet having (1) a frangible outer casing, and (2) an adhesive substance contained within said outer casing, (3) electronic circuitry contained in the outer casing, the circuitry including an outer surface covered with said adhesive substance which adheres to a surface of a fleeing vehicle upon contact therewith, the circuitry including (a) first circuitry which generates a tracking signal upon activation, (b) second circuitry which generates a traffic signal control signal upon activation, and (c) third circuitry which activates the first circuitry and the second circuitry upon impact with a fleeing vehicle; J (B) projecting means for projecting the multiplicity of pellets at a fleeing vehicle;

(C) in-vehicle receiver circuitry located in a pursuing vehicle which receives signals generated by the first circuitry when the first circuitry is activated upon impact with the fleeing vehicle and generate tracking signals in the pursuing vehicle; and (D) traffic-light receiver circuitry in roadway intersection traffic lights which receives signals from the second circuitry attached to a fleeing vehicle when the second circuitry is activated upon impact with the fleeing vehicle and generate traffic-light control signals to turn an associated traffic light green for a roadway on which the fleeing vehicle is traveling and red for all traffic on roadways intersecting the roadway on which the fleeing vehicle is traveling.

3. The system defined in claim 2 wherein the projecting means includes a firearm.

4. The system defined in claim 3 wherein the multiplicity of pellets are contained in a casing located in the firearm.

* * * * *